US006774034B2

(12) United States Patent
Byun et al.

(10) Patent No.: US 6,774,034 B2
(45) **Date of Patent: *Aug. 10, 2004**

(54) ORGANOMETALLIC PRECURSOR FOR FORMING METAL PATTERN AND METHOD OF FORMING METAL PATTERN USING THE SAME

(75) Inventors: Young Hun Byun, Daejun-Shi (KR); Soon Taik Hwang, Daejun-Shi (KR); Euk Che Hwang, Daejun-Shi (KR)

(73) Assignee: Samsung Electronics Co., LTD, Suwon-shi (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/425,882

(22) Filed: Apr. 30, 2003

(65) Prior Publication Data

US 2003/0207568 A1 Nov. 6, 2003

(30) Foreign Application Priority Data

Apr. 30, 2002 (KR) ..... 2002-23754

(51) Int. Cl.[7] ..... H01L 21/4763

(52) U.S. Cl. ..... 438/650; 438/669; 438/674; 438/681; 438/686; 438/687

(58) Field of Search ..... 438/650, 669, 438/674, 681, 686–687

(56) References Cited

U.S. PATENT DOCUMENTS

| | | | | |
|---|---|---|---|---|
| 5,064,685 A | | 11/1991 | Kestenbaum et al. | |
| 5,534,312 A | * | 7/1996 | Hill et al. | 427/533 |
| 2003/0124457 A1 | * | 7/2003 | Jung et al. | 430/270.1 |
| 2003/0157440 A1 | * | 8/2003 | Byun et al. | 430/322 |

FOREIGN PATENT DOCUMENTS

JP 62-263973 A 11/1987

* cited by examiner

*Primary Examiner*—Lynne Gurley
(74) *Attorney, Agent, or Firm*—Birch, Stewart, Kolasch & Birch, LLP

(57) ABSTRACT

An organometallic precursor for forming a metal pattern and a method of forming the metal pattern using the same, in which an electrically conductive metal pattern is formed using an organometallic precursor, through an exposing step without using a separate photosensitive resin. The exposure time required to dissociate the organic ligands from the metals of the organometallic precursor is very short making the overall patterning process very efficient.

17 Claims, 1 Drawing Sheet

ORGANOMETALLIC PRECURSOR FOR FORMING METAL PATTERN AND METHOD OF FORMING METAL PATTERN USING THE SAME

BACKGROUND OF THE INVENTION

This application claims the benefit of the Korea Application No. 2002-23754 filed on Apr. 30, 2002, which is hereby incorporated by reference.

1. Field of the Invention

The present invention relates to an organometallic precursor for forming a metal pattern and a method of forming a metal pattern using the same. More particularly, the present invention relates to an organometallic precursor for forming a micro- or a nano-sized conductive metal pattern using light and without using a photosensitive resin and a method of forming such a metal pattern using the same.

2. Description of the Prior Art

As is well known to those skilled in the art, a patterned thin film formed on a substrate using materials having different electrical properties has been applied to various electronic devices. In an electronic device production process, a metal thin film is generally coated on a substrate such as a crystallized silicon wafer and then patterned.

A conventional method of forming a metal pattern comprises the steps of depositing an organometallic compound on a silicon or glass substrate using a chemical vapor deposition process or an atomic layer deposition process to form a thin film on the substrate; coating a photoresist on the resulting substrate according to a spin coating process; patterning the photoresist film according to a photolithography process; and etching the organometallic film through the patterned photoresist film. Another conventional method of forming a metal pattern comprises the steps of forming a metal film on a substrate according to a plasma deposition process, a sputtering process, or an electric plating process; coating a photosensitive resin on the resulting substrate; patterning the coated substrate using light; and etching the patterned substrate to form a desired metal pattern. These conventional methods require a high temperature and vacuum devices, and a patterning step using the photosensitive resin and an etching step for removing the photosensitive resin, thus having the disadvantage of a high production cost due to a complicated process. Other disadvantages of these conventional methods are that the resolution of the resulting pattern is inevitably reduced because the patterning and etching steps are typically repeated several times, and that the surface of a deposited metal film is not smooth, causing these conventional methods to additionally require a flatting step.

Meanwhile, various methods of forming a metal pattern without using a photoreaction have been suggested. For example, Japanese Patent Publication No. 62-263973 discloses a method of forming a metal pattern, in which an electronic beam is irradiated on a thin film of an organometallic compound without inducing any photoreaction. In addition, U.S. Pat. No. 5,064,685 discloses a method of forming a thin metal film using a thermal decomposition reaction, comprising the steps of coating an organometallic compound-containing ink on a substrate; and heating the resulting substrate with the use of a laser beam. According to this patent, the substrate is exposed to a high temperature, and materials other than metals are prevented from being deposited on the substrate.

Another example of a method of forming a metal pattern is proposed by U.S. Pat. No. 5,534,312, in which organic compounds sensitive to light are coordinate-bonded to a metal to produce an organometallic compound, the organometallic compound thus produced is coated on a substrate, and the resulting substrate is irradiated by the light to form a metal pattern without a coating step using a photosensitive resin. The organometallic compound according to this patent necessarily includes at least one ligand selected from the group consisting of acetylacetonates, dialkyldithiocarbamates, carboxylates, pyridines, amines, diamines, arsines, diarsines, phosphines, diphosphines, arenes, alkoxy ligands, alkyl ligands, and aryl ligands. Particularly, when the organometallic compound includes two or more ligands, at least one ligand is selected from the group consisting of oxalato, halogen, hydrogen, hydroxy, cyano, carbonyl, nitro, nitrito, nitrate, nitrosyl, ethylene, acetylene, thiocyanato, isothiocyanato, aquo, azide, carbonato, amine, and thiocarbonyl. According to this patent, when the organometallic compound is coated on the substrate and exposed through a patterned mask, the light is directly reacted with the organometallic compound to decompose organic ligands coordinate-bonded to the metal to separate the organic ligands from the metal and to react the metal with surrounding metal atoms and/or oxygen in the atmosphere to form a metal or a metal oxide film pattern. However, this patent is disadvantageous in that the organometallic compound as described above is slowly decomposed by exposure to light, and so the pattern forming rate is slow. Other disadvantages are that a ligand contamination is caused because most ligands are separated from the metal by a photoreaction to form the metal or metal oxide film, and the oxide film thus formed is reduced and annealed under a mixed gas of hydrogen with nitrogen at 200° C. or higher for 30 minutes to several hours so as to improve conductivity of the oxide film.

In addition, there remains an urgent need to develop a metal compound capable of readily forming a metal pattern and meeting an increasing demand for fineness and low specific resistance of metal wiring in the modern semiconductor industry.

SUMMARY OF THE INVENTION

Accordingly, the present invention has been made, keeping in mind the above disadvantages occurring in the prior art, and an object of the present invention is to provide an organometallic precursor for precisely forming a conductive metal pattern, in which ligands are readily separated by light from metals so as to reduce the time for forming the metal pattern.

It is another object of the present invention to provide a method of forming a metal pattern using such an organometallic precursor.

It is still another object of the present invention to provide an organometallic precursor mixture of the above organometallic precursor with another organometallic precursor.

It is yet another object of the present invention to provide a method of forming a metal pattern using such an organometallic precursor mixture.

According to a first aspect of the present invention, an organometallic precursor is provided for forming a metal pattern defined by the following Formula (I):

$$M_mL_nL'_oX_p \quad (I)$$

wherein,

M is a transition metal selected from the group consisting of Ag, Au, and Cu;

L is a neutral ligand selected from the group consisting of amines, phosphines, phosphites($P(OR)_3$), phosphine oxides, arsines, and thiols;

L' is a negatively charged ligand selected from the group consisting of β-diketonates, β-ketoiminates, β-diiminates, carboxylates, and dialkyldithiocarbamates;

X is an anion selected from the group consisting of halogeno, hydroxide ($OH^-$), cyanide ($CN^-$), nitrite ($NO_2^-$), nitrate ($NO_3^-$), nitroxyl ($NO^-$), azide ($N_3^-$), thiocyanato, isothiocyanato, tetralkylborate, tetrahaloborate, hexafluorophosphate ($PF_6^-$), triflate ($CF_3SO_3^-$), tosylate ($Ts^-$), sulfate ($SO_4^{2-}$), and carbonate ($CO_3^{2-}$);

m is an integer ranging from 1 to 10;

n is an integer ranging from 1 to 40;

o is an integer ranging from 0 to 10; and p is an integer ranging from 0 to 10.

According to a second aspect of the present invention, a method is provided for forming a metal pattern, comprising the steps of dissolving the organometallic precursor in an organic solvent to provide a coating solution; applying the coating solution on a substrate to form a thin film on the substrate; exposing the thin film with the use of a photomask; and developing the exposed thin film to form a metal or metal oxide pattern on the substrate.

According to a third aspect of the present invention, an organometallic precursor mixture is provided for forming a metal pattern, produced by mixing the organometallic precursor defined by the above Formula (I) with another organometallic precursor defined by the following Formula (II) in a metal weight ratio of 99.1:0.1 to 80:20:

$$M'_aL''_bL'''_cX_p \quad \text{(II)}$$

wherein,

M' is a transition metal selected from the group consisting of Ti, Zr, V, Ta, Cr, Mo, W, Mn, Fe, Ru, Os, Co, Rh, Ir, Ni, Pd, Pt, Cu, Ag, and Au, or an alkaline earth metal selected from the group consisting of Mg, Ca, Sr, and Ba;

L'' is a neutral ligand selected from the group consisting of amines, phosphines, phosphites, phosphine oxides, arsines, thiols, carbonyl compounds, alkenes, alkynes, and arenes;

L''' is a negatively charged ligand selected from the group consisting of alkyl, β-diketonates, β-ketoiminates, β-diiminates, carboxylates, dialkyldithiocarbamates, alkoxides, and amidos;

X is an anion selected from the group consisting of halogeno, hydroxide ($OH^-$), cyanide ($CN^-$), nitrite ($NO_2^-$), nitrate ($NO_3^-$), nitroxyl ($NO^-$), azide ($N_3^-$), thiocyanato, isothiocyanato, tetralkylborate, tetrahaloborate, hexafluorophosphate ($PF_6^-$), triflate ($CF_3SO_3^-$), tosylate ($Ts^-$), sulfate ($SO_4^{2+}$), and carbonate ($CO_3^{2-}$);

a is an integer ranging from 1 to 10;

b is an integer ranging from 1 to 40;

c is an integer ranging from 0 to 10; and p is an integer ranging from 0 to 10.

According to a fourth aspect of the present invention, a method is provided for forming a metal alloy pattern, comprising the steps of dissolving the organometallic precursor mixture in an organic solvent to provide a coating solution; applying the coating solution on a substrate to form a thin film on the substrate; exposing the thin film with the use of a photomask; and developing the exposed thin film to form a metal alloy or metal alloy oxide pattern on the substrate.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
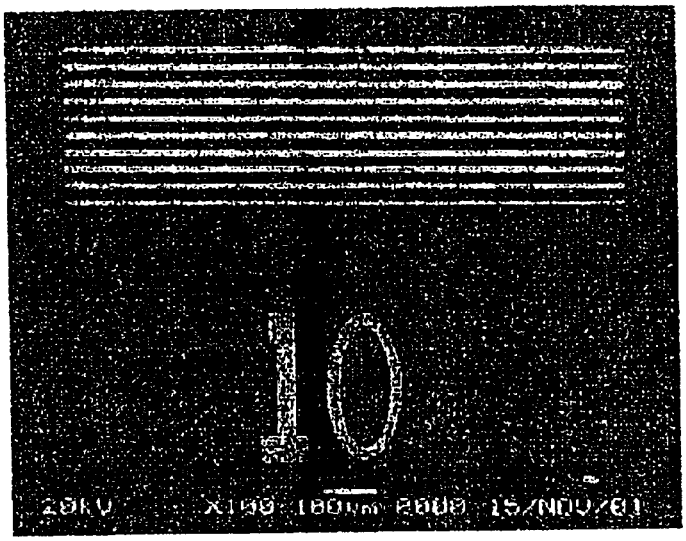
FIG. 1 is an electrophotogram of a metal pattern formed according to example 18 of the present invention.
Figure 2:
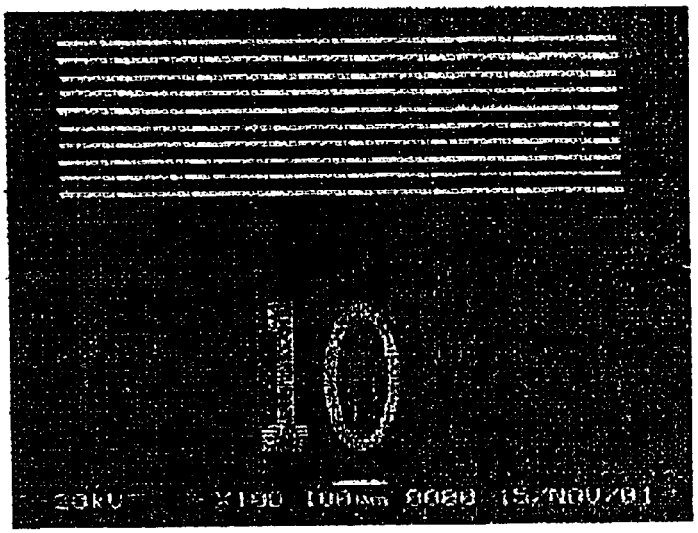
FIG. 2 is an electrophotogram of a metal pattern formed according to example 19 of the present invention.

The present invention provides an organometallic precursor defined by the following Formula (I):

$$M_mL_nL'_oX_p \quad \text{(I)}$$

wherein,

M is a transition metal selected from the group consisting of Ag, Au, and Cu;

L is a neutral ligand selected from the group consisting of amines, phosphines, phosphites, phosphine oxides, arsines, and thiols;

L' is a negatively charged ligand selected from the group consisting of β-diketonates, β-ketoiminates, β-diiminates, carboxylates, and dialkyldithiocarbamates;

X is an anion selected from the group consisting of halogeno, hydroxide ($OH^-$), cyanide ($CN^-$), nitrite ($NO_2^-$), nitrate ($NO_3^-$), nitroxyl ($NO^-$), azide ($N_3^-$), thiocyanato, isothiocyanato, tetralkylborate, tetrahaloborate, hexafluorophosphate ($PF_6^-$), triflate ($CF_3SO_3^-$), tosylate ($Ts^-$), sulfate ($SO_4^{2-}$), and carbonate ($CO_3^{2-}$);

m is an integer ranging from 1 to 10;

n is an integer ranging from 1 to 40;

o is an integer ranging from 0 to 10; and p is an integer ranging from 0 to 10.

The organometallic precursor defined by Formula (I) is preferably characterized in that M is Ag or Au; L is a neutral ligand selected from the group consisting of primary aliphatic amines, phosphites, and phosphine oxides; L' is a negatively charged ligand selected from the group consisting of β-diketonates, β-diiminates, and carboxylates; X is an anion selected from the group consisting of cyanide ($CN^-$), nitrite ($NO_2^-$), and nitrate ($NO_3^-$); m is an integer ranging from 1 to 10; n is an integer ranging from 1 to 40; o is an integer ranging from 0 to 10; and p is an integer ranging from 0 to 10.

Organic ligands constituting the organometallic precursor of the present invention, that is to say, L and L' are readily separated from a central metal during the exposing step because they are sensitive to light, and so when the inventive organometallic precursor is used to form a metal pattern, separate photosensitive resin coating and etching steps are unnecessary in contrast to the prior art.

According to the present invention, a method is provided for forming a metal pattern using the organometallic precursor. At this time, the metal pattern is formed using the organometallic precursor defined by Formula (I) alone or an organometallic precursor mixture produced by mixing the organometallic precursor defined by Formula (I) with another organometallic precursor defined by the following Formula (II) in a metal weight ratio of 99.1:0.1 to 80:20:

$$M'_aL''_bL'''_cX_p \quad \text{(II)}$$

wherein,

M' is a transition metal selected from the group consisting of Ti, Zr, V, Ta, Cr, Mo, W, Mn, Fe, Ru, Os, Co, Rh, Ir, Ni, Pd, Pt, Cu, Ag, and Au, or an alkaline earth metal selected from the group consisting of Mg, Ca, Sr, and Ba;

L" is a neutral ligand selected from the group consisting of amines, phosphines, phosphites, phosphine oxides, arsines, thiols, carbonyl compounds, alkenes, alkynes, and arenes;

L'" is a negatively charged ligand selected from the group consisting of alkyl, β-diketonates, β-ketoiminates, β-diiminates, carboxylates, dialkyldithiocarbamates, alkoxides, and amidos;

X is an anion selected from the group consisting of halogeno, hydroxide ($OH^-$), cyanide ($CN^-$), nitrite ($NO_2^-$), nitrate ($NO_3^-$), nitroxyl ($NO^-$), azide ($N_3^-$), thiocyanato, isothiocyanato, tetralkylborate, tetrahaloborate, hexafluorophosphate ($PF_6^-$), triflate ($CF_3SO_3^-$), tosylate ($Ts^-$), sulfate ($SO_4^{2-}$), and carbonate ($CO_3^{2-}$);

a is an integer ranging from 1 to 10;

b is an integer ranging from 1 to 40;

c is an integer ranging from 0 to 10; and p is an integer ranging from 0 to 10.

When the content of the organometallic precursor (particularly, wherein M' is a metal other than Cu, Ag, and Au) defined by the Formula (II) in the organometallic precursor mixture of the present invention is higher than 20 wt % based on metal weight, specific resistance of the resulting coating film is undesirably increased and the photoreaction rate becomes slow.

According to the patterning method of the present invention, the organometallic precursor or the organometallic precursor mixture is dissolved in a solvent and applied on a substrate to form a thin film on the substrate. Illustrative, but non-limiting examples of the substrate useful to form the pattern according to the present invention include an inorganic material substrate such as a silicon or glass substrate, an organic material substrate such as a plastic substrate, or a substrate made of a composite of the inorganic material with the organic material.

The organometallic precursor is applied on the substrate according to any of various known coating processes including, but not limited to, a spin coating process, a roll coating process, a dip coating process, a spray coating process, a flow coating process, and a screen printing process, but preferably according to a spin coating process.

Illustrative, but non-limiting examples of the organic solvent, in which the organometallic precursor is dissolved to provide a coating solution, include a nitrile-based solvent such as acetonitrile, propionitrile, isobutylnitrile, pentanenitrile, hexanenitrile, and heptanenitrile; an aliphatic hydrocarbon-based solvent such as hexane, heptane, octane, and dodecane; an aromatic hydrocarbon-based solvent such as anisole, mesitylene, and xylene; a ketone-based solvent such as methyl isobutyl ketone, 1-methyl-2-pyrrolidinone, cyclohexanone, and acetone; an ether-based solvent such as tetrahydrofuran, diisobutyl ether, and isopropyl ether; an acetate-based solvent such as ethyl acetate, butyl acetate, and propylene glycol methyl ether acetate; an alcohol-based solvent such as isopropyl alcohol, butyl alcohol, hexyl alcohol, and octyl alcohol; a silicone-based solvent; and a mixture thereof.

The thin film consisting of the organometallic precursor is provided with a photomask, and the precursor compound exposed to light, is decomposed, thus differentiating the solubility of the exposed portion from that of the non-exposed portion. In other words, the exposed compound is converted into another compound different from the original compound and, in detail, when an organic ligand bonded to a metal atom is separated from the metal atom by electromagnetic radiation, the metal compound becomes more unstable to be rapidly decomposed into a metal or a metal oxide depending on the processing atmosphere. A photochemical reaction mechanism of the organometallic precursor of the present invention depends on the metal and the ligand. In general, however, it is surmised that a bond between the metal and the ligand is weakened according to four mechanisms, that is to say, the metal to ligand charge transfer mechanism, the ligand to metal charge transfer mechanism, the d-d excitation state mechanism, and the intramolecular charge transfer mechanism, and is completely cut to decompose the metal/ligand structure. Ultraviolet light is the most preferred source of light for the electromagnetic radiation.

After the exposing step, the exposed thin film is developed with an organic solvent to produce a desired pattern. The organic solvent used in coating the substrate, as described above, may be used as a solvent to develop the thin film, and inorganic solvents, for example TMAH, may be also used. Examples of the organic solvent are given herein for purposes of illustration only and are not intended to limit the present invention.

The resulting pattern may be additionally subjected to an oxidizing, a reducing, and/or an annealing step so as to improve its physical properties, such as the conductivity and adhesive force of the thin film. The oxidizing step is conducted in order to obtain a pure metal oxide pattern, and is readily accomplished by reacting the pattern with an oxidizing agent. The oxidizing agent may be an organic oxidizing agent including N-oxides such as trimethylamine N-oxide and pyridine N-oxide, peroxides such as bis (trimethylsilyl) peroxide, perbenzoic acid, $O_3$, and $O_2$, or may be an inorganic oxidizing agent including $H_2O_2$, $H_2SO_4$, and $HNO_3$. The oxidizing condition may be varied according to the oxidizing agent to be used, while liquid- or gas-phase oxidation is typically performed. On the other hand, the reducing step is conducted in order to obtain a pure metal pattern, and is readily accomplished by reacting the pattern with a reducing agent. Useful reductants can be exemplified by organic reductants including hydrazines, silanes, amines, and derivatives thereof, as well as inorganic reductants including metal hydrides such as $NaBH_4$ and $LiAlH_4$. These reductants can be used as itself or as a solution in a suitable solvent, and can be applied to a gas- or liquid-phase reduction as needed. Meanwhile, the annealing step is conducted under a mixed gas atmosphere of hydrogen with nitrogen, a nitrogen gas atmosphere, or an air atmosphere at 300° C. or lower, preferably 200° C. or lower. Because the organometallic precursor of the present invention can be annealed at a relatively low temperature of 300° C. or lower unlike a conventional compound for forming a pattern, the present invention can be applied to a glass or a plastic substrate which is sensitive to heat.

The method of forming the metal pattern according to the present invention can be applied to provide a metal (or metal alloy) thin film capable of replacing a sputter layer of a flexible display or a flat panel display, or to a CMP-free damascene process or a PR-free ITO layer forming process.

A better understanding of the present invention may be obtained in light of the following examples which are set forth to illustrate, but are not to be construed to limit the present invention. All compounds used herein are synthesized under a nitrogen atmosphere without moisture or oxygen in the Schlenk flask according to a Schlenk or Glove box technique.

PREPARATION EXAMPLE 1

Synthesis of Compound (1): $PPh_3Ag$(benzoate)

4.3 g (30 mmol) of sodium benzoate was dissolved in a mixture of water and ethanol (1:1) in a round Schlenk flask with a volume of 100 ml, and 20 ml of aqueous solution containing 5.1 g (30 mmol) of $AgNO_3$ was then slowly added to the flask with the use of a cannular. White precipitates were generated in the flask when the $AgNO_3$ solution was added into the flask. The resulting mixture was agitated at room temperature for 1 hour, and the white precipitates (silver benzoate) were filtered using a paper filter, rinsed with water and ethanol two or three times, and dried. 2.3 g (10 mmol) of the resulting silver benzoate was put into another round Schlenk flask with a volume of 100 ml and 30 ml of THF was then added into the flask to produce a slurry. 2.6 g (10 mmol) of solid $PPh_3$ (triphenyl phosphine) was added to the slurry and the resulting mixture was agitated for 2 hours, thus gradually dissolving silver benzoate to obtain a colorless and transparent solution. The solution was filtered using a 0.2 $\mu$m membrane filter, and all solvent was removed from the filtrate under a reduced pressure to yield 3.8 g (77% yield) of white participate. The resulting $PPh_3Ag$ (benzoate) compound was dissolved in THF and left under normal atmosphere to produce a colorless crystal. X-ray structure of $PPh_3Ag$(benzoate) is as follows:

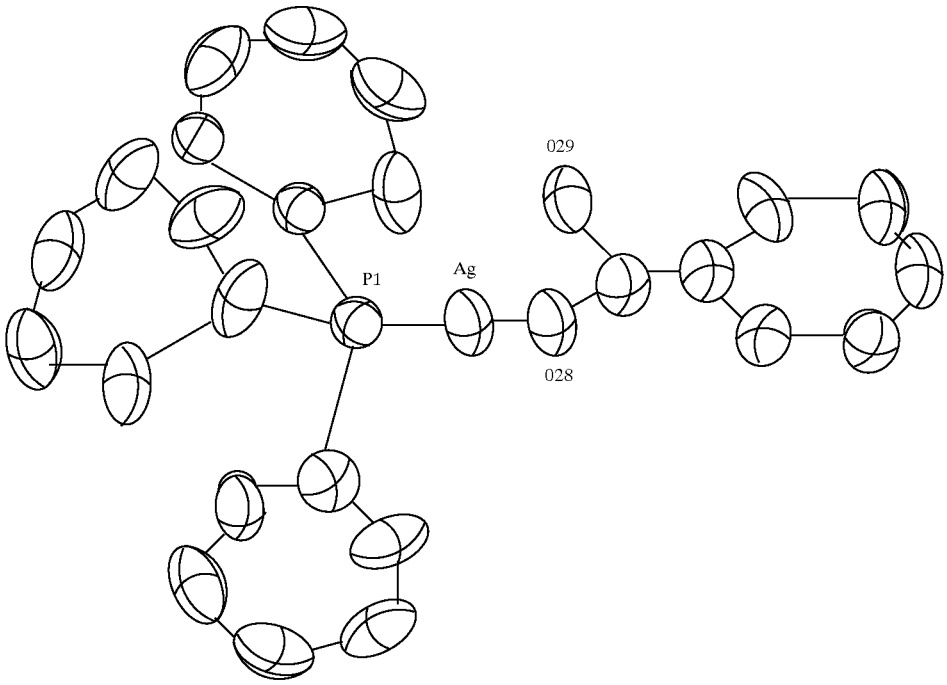

PREPARATION EXAMPLE 2

Synthesis of Compound (2): AG(DBM) (DBM= Dibenzoylmethanoate)

11.2 g (50 mmol) of dibenzoyl methane was dissolved in 100 ml of methanol in a round Schlenk flask with a volume of 500 ml. 4 g (100 mmol) of sodium hydroxide was then dissolved in 50 ml of distilled water and the resulting sodium hydroxide solution was slowly added to the dibenzoyl methane solution in the flask. The resulting solution was agitated for about 1 hour, and 50 ml of aqueous solution containing 8.5 g (50 mmol) of $AgNO_3$ was then slowly added into the flask with the use of a cannular. Grey precipitates were generated in the flask when the $AgNO_3$ solution was added into the flask. The resulting mixture was agitated at room temperature for about 2 hours, and the precipitates were filtered using a filter, rinsed with distilled water and methanol four or five times and finally with dimethylether once, and dried under vacuum. Thereby, 13.4 g of silver dibenzoylmethanoate was obtained (81% yield), while NMR data thereof could not obtained because silver dibenzoylmethanoate is poorly dissolved in most laboratory solvents.

PREPARATION EXAMPLE 3

Synthesis of Compound (3): $PPh_3Ag$(DBM)

993 mg (3 mmol) of silver dibenzoylmethanoate obtained from preparation example 2 was put into a round Schlenk flask with a volume of 100 ml, and 30 ml of THF was then added into the flask to produce a slurry. 10 ml of THF solution containing 0.8 g (3.1 mmol) of $PPh_3$ was added to the slurry and the resulting mixture was agitated for 3 hours, resulting in gradual change of the slurry into a transparent and light yellow solution. The light yellow solution was filtered using a 0.2 μm membrane filter, and all solvent was removed from the filtrate under a reduced pressure to obtain 1.2 g of white powder (67% yield).

PREPARATION EXAMPLE 4

Synthesis of Compound (4): $PCy_3Ag(DBM)$ (Cy=Cyclohexyl)

993 mg (3 mmol) of silver dibenzoylmethanoate obtained from preparation example 2 was put into a round Schlenk flask with a volume of 100 ml, and 30 ml of THF was then added into the flask to produce a slurry. 10 ml of THF solution containing 0.87 g (3.1 mmol) of $PCy_3$ (tricyclohexyl phosphine) was added to the slurry and the resulting mixture was agitated for 3 hours, resulting in gradual change of the slurry into a transparent and light yellow solution. The light yellow solution was filtered using a 0.2 μm membrane filter, and all solvent was removed from the filtrate under a reduced pressure to obtain 1.2 g of yellow powder (65% yield).

PREPARATION EXAMPLE 5

Synthesis of Compound (5): (TMEDA)Ag(DBM) (TMEDA=Tetramethyl Ethylenediamine)

1.65 g (5 mmol) of silver dibenzoylmethanoate obtained from preparation example 2 was put into a round Schlenk flask with a volume of 100 ml, and 30 ml of THF was then added into the flask to produce a slurry. 0.7 g (6 mmol) of TMEDA was slowly added to the slurry with the use of a syringe and the resulting mixture was agitated for 3 hours, resulting in gradual change of the slurry into a transparent yellow solution. The yellow solution was filtered using a 0.2 μm member filter, and all solvent was removed from the filtrate under a reduced pressure to obtain 1.7 of grey powder (73% yield).

PREPARATION EXAMPLE 6

Synthesis of Compound (6): (Py)Ag(DBM) (Py=Pyridine)

0.33 g (1 mmol) of silver dibenzoylmethanoate obtained from preparation example 2 was put into a round Schlenk flask with a volume of 50 ml, and 10 ml of THF was then added into the flask to produce a slurry. 0.08 g (1 mmol) of pyridine was slowly added to the slurry with the use of a syringe and the resulting mixture was agitated for 3 hours, resulting in gradual change of the slurry into a transparent yellow solution. The yellow solution was filtered using a 0.2 μm membrane filter, and all solvent was removed from the filtrate under a reduced pressure to obtain 0.29 g of yellow powder (71% yield).

PREPARATION EXAMPLE 7

Synthesis of Compound (7): $Ag(NH_2Pr)_n(NO_3)$ (n=1, 2, 3 and 4)

3.4 g (20.0 mmol) of $AgNO_3$ was dissolved in 15 ml of acetonitrile ($CH_3CN$) in a round Schlenk flask with a volume of 50 ml, and 3.6 g (60.9 mmol) of propylamine was then added dropwise to the flask with the use of a syringe. The resulting mixture was reacted at room temperature for about 1 hour with agitation, and filtered using a 0.2 μm membrane filter, and excess propylamine and acetonitrile were removed from the filtrate under a reduced pressure to obtain a transparent oil. A mass spectrum analysis and an atomic analysis of the transparent yellow oil confirmed that different compounds each comprising 1 to 4 propylamines were present, and a silver metal existed in a ratio to propylamine of 1:1.2. This suggests that a compound consisting of a silver atom combined with propylamine in a ratio of 1:1 is a main product, but the compound is expected to be unstable when it exists alone. Analysis results of each compound, produced by reacting $AgNO_3$ with propylamine in a ratio of 1:1 (m/m) and 1:3 (m/m), by a $^1$H-NMR spectrum are same as each other. From the analysis result, as described below, of the transparent yellow oil, it can be seen that all protons resonated slightly upfield compared to those of pure propylamine:

$^1$H-NMR($CD_3CN$, ppm): 2.68 [t, 2H, N—$CH_2$], 1.49 [m, 2H, $CH_2CH_3$], 0.90 [t, 3H, $CH_2CH_3$].

PREPARATION EXAMPLE 8

Synthesis of Compound (8): $Ag(NH_2Pr)_n(NO_2)$ (n=1, 2, 3, and 4)

3.08 g (20.0 mmol) of $AgNO_2$ was dissolved in 15 ml of acetonitrile ($CH_3CN$) in a round Schlenk flask with a volume of 50 ml, and 3.6 g (60.9 mmol) of propylamine was then added dropwise to the flask with the use of a syringe. The resulting mixture was reacted at room temperature for 1 hour with agitation and filtered using a 0.2 μm membrane filter, and excess propylamine and acetonitrile were removed from the filtrate under a reduced pressure to obtain a transparent yellow oil. The analysis result of the transparent yellow oil by a $^1$H-NMR spectrum is similar to that of the compound of preparation example 7. From the analysis result, as described below, of the transparent yellow oil, it can be seen that all protons resonated slightly upfield compared to those of pure propylamine:

$^1$H-NMR($CD_3OD$, ppm): 4.87 [s, 2H, $H_2N$—$CH_2$], 2.77 [t, 2H, N—$CH_2$], 1.61 [m, 2H, $CH_2CH_3$], 1.02 [t, 3H, $CH_2CH_3$].

PREPARATION EXAMPLE 9

Synthesis of Compound (9): Ag(n-Butylamine)$_n$ ($NO_2$) (n=1, 2, 3, and 4)

3.08 g (20.0 mmol) of $AgNO_2$ was dissolved in 15 ml of acetonitrile ($CH_3CN$) in a round Schlenk flask with a volume of 50 ml, and 4.4 g (61 mmol) of butylamine was then added dropwise into the flask with the use of a syringe. The resulting mixture was reacted at room temperature for about 1 hour with agitation and filtered using a 0.2 μm membrane filter, and excess butylamine and acetonitrile were removed from the filtrate under a reduced pressure to obtain a foamy colorless solid. The solid was melted at a slightly increased temperature, around 25 to 30° C. to form oil. From the analysis result, as described below, of the colorless solid by a $^1$H-NMR spectrum, it can be seen that all protons resonated slightly upfiled compared to those of pure n-butylamine:

$^1$H-NMR($CD_3CN$, ppm): 2.72 [t, 2H, N—$CH_2$], 2.42 [br, 2H, —$NH_2$], 1.49 [m, 2H, —$CH_2CH_2CH_3$], 1.39 [m, 2H, —$CH_2CH_2CH_3$], 0.92 [t, 3H, —$CH_2CH_3$].

PREPARATION EXAMPLE 10

Synthesis of Compound (10): Ag(n-Hexylamine)$_n$ ($NO_2$) (n=1, and 2)

1.53 g (10.0 mmol) of $AgNO_2$ was dissolved in 15 ml of acetonitrile ($CH_3CN$) in a round Schlenk flask with a volume of 50 ml, and 2.22 g (22 mmol) of hexylamine was then added dropwise into the flask with the use of a syringe. The resulting mixture was reacted at room temperature for about 1 hour with agitation and filtered using a 0.2 μm membrane filter, and excess hexylamine and acetonitrile were removed from the filtrate under a reduced pressure to obtain a foamy colorless solid. The solid was melted at a slightly increased temperature, around 30° C. to form oil. From the analysis result, as described below, of the colorless solid by a $^1$H-NMR spectrum, it can be seen that all protons resonated slightly upfield compared to those of pure hexylamine:

$^1$H-NMR($CD_3CN$, ppm): 2.80 [t, 2H, $H_2NCH_2$], 2.39 [b, 2H, $NH_2$], 1.64 [m, 2H, $NCH_2CH_2$], 1.45 [b, 6H, $NCH_2CH_2CH_2CH_2CH_2CH_3$], 1.05 [t, 3H, —$CH_2CH_3$].

PREPARATION EXAMPLE 11

Synthesis of Compound (11): Ag(n-Heptylamine)$_n$ ($NO_2$) (n=1 and 2)

3.08 g (20.0 mmol) of $AgNO_2$ was dissolved in 15 ml of acetonitrile ($CH_3CN$) in a round Schlenk flask with a volume of 50 ml, and 4.61 g (40 mmol) of heptylamine was then added dropwise into the flask with the use of a syringe. The resulting mixture was reacted at room temperature for about 1 hour with agitation and filtered using a 0.2 μm membrane filter, and excess heptylamine and acetonitrile were removed from the filtrate under a reduced pressure to obtain a foamy colorless solid. The solid was melted at a slightly increased temperature, around 30° C. to form oil. From the analysis result, as described below, of the colorless solid by a $^1$H-NMR spectrum, it can be seen that all protons resonated slightly upfield compared to those of pure heptylamine:

$^1$H-NMR($CD_3CN$, ppm): 2.83 [b, 2H, $H_2NCH_2$], 2.30 [b, 2H, $NH_2$], 1.61 [t, 2H, $NCH_2CH_2$], 1.45 [b, 8H, $NCH_2CH_2CH_2CH_2CH_2CH_2CH_3$], 1.05 [t, 3H, —$CH_2CH_3$].

PREPARATION EXAMPLE 12

Synthesis of Compound (12): Ag(n-Octylamine)$_n$ ($NO_2$) (n=1 and 2)

3.08 g (20.0 mmol) of $AgNO_2$ was dissolved in 15 ml of acetonitrile ($CH_3CN$) in a round Schlenk flask with a volume of 50 ml, and 5.05 g (40 mmol) of octylamine was then added dropwise into the flask with the use of a syringe. The resulting mixture was reacted at room temperature for about 1 hour with agitation and filtered using a 0.2 μm membrane filter, and excess octylamine and acetonitrile were removed from the filtrate under a reduced pressure to obtain a foamy colorless solid. The solid was melted at a slightly increased temperature, around 30° C. to form oil. From the analysis result, as described below, of the colorless solid by a $^1$H-NMR spectrum, it can be seen that all protons resonated slightly upfield compared to those of pure octylamine:

$^1$H-NMR($CD_3CN$, ppm): 2.82 [t, 2H, $H_2NCH_2$], 2.40 [b, 2H, $NH_2$], 1.62 [b, 2H, $NCH_2CH_2$], 1.45 [b, 10H, $NCH_2CH_2CH_2CH_2CH_2CH_2CH_2CH_3$], 1.05 [t, 3H, —$CH_2CH_3$].

PREPARATION EXAMPLE 13

Synthesis of Compound (13): Ag(iso-Butylamine)$_n$ ($NO_2$) (n=1 and 2)

1.53 g (10.0 mmol) of $AgNO_2$ was dissolved in 15 ml of acetonitrile ($CH_3CN$) in a round Schlenk flask with a volume of 50 ml, and 1.6 g (22 mmol) of iso-butylamine was then added dropwise into the flask with the use of a syringe. The resulting mixture was reacted at room temperature for about 1 hour with agitation and filtered using a 0.2 μm membrane filter, and excess iso-butylamine and acetonitrile were removed from the filtrate under a reduced pressure to obtain a foamy colorless solid. The solid was melted at a slightly increased temperature, around 30° C. to form oil. From the analysis result, as described below, of the colorless solid by a $^1$H-NMR spectrum, it can be seen that all protons resonated slightly upfield compared to those of pure iso-butylamine:

$^1$H-NMR($CD_3CN$, ppm): 2.64 [d, 2H, N—$CH_2$], 1.81 [m, 1H, $CH_2CH(CH_3)_2$], 1.10 [d, 6H, $CH_2CH(CH_3)_2$].

PREPARATION EXAMPLE 14

Synthesis of Compound (14): Au(n-butylamine)$_n$ (CN) (n=1 and 2)

1.12 g (5 mmol) of AuCN was mixed with 15 ml of acetonitrile ($CH_3CN$) in a round Schlenk flask with a volume of 50 ml to produce a slurry, and 0.82 g (11 mmol) of n-butylamine was then added dropwise to the slurry with the use of a syringe. The resulting mixture was agitated at room temperature for about 1 hour to be converted into a deep yellow solution. After 2 hours, the solution was filtered using a 0.2 μm membrane filter, and excess butylamine and acetonitrile were removed from the filtrate under a reduced pressure to obtain brown oil. From the analysis result, as described below, of the brown oil by a $^1$H-NMR spectrum, it can be seen that all protons resonated slightly upfield compared to those of pure n-butylamine:

$^1$H-NMR($CD_3CN$, ppm): 3.81 [br, 2H, $H_2NCH_2$—], 2.92 [m, 2H, N—$CH_2$], 1.60 [m, 2H, —$CH_2CH_2CH_3$], 1.39 [m, 2H, —$CH_2CH_2CH_3$], 0.93 [s, 3H, —$CH_2CH_2CH_3$].

EXAMPLES 1 to 17 AND COMPARATIVE EXAMPLE

Organometallic precursors synthesized in the above preparation examples were dissolved in a coating solvent and then applied on a glass substrate in an air atmosphere according to a spin coating process. The resulting coating film was exposed through a photomask and developed using a developing solvent. At this time, a broadband Uv light generated by Oriel 60200 (200 W, Oriel, USA) was used as a source of light. The developed film was reduced by use of 0.1 M hydrazine solution (in isopropyl alcohol) and/or annealed at 100° C. Unless otherwise specified, annealing was conducted in an air atmosphere.

As described in following Table 1, compounds are different from each other in view of photo-reactivity and reducibility. In addition, in the case of examples of the present invention, a conductive metallic patterned film were readily formed through an exposing step during ones to tens minutes. On the other hand, in the case of the comparative example, no photo-reaction occurred during an exposing step lasting 120 minutes, and thus a metal film was not formed at all.

TABLE 1

| | [1]Organo. | [2]Coa. | [3]Con. | [4]Time | [5]Dev. | [6]Reduct. | [7]Anneal. | [8]Res. |
|---|---|---|---|---|---|---|---|---|
| CoEx. | $Ni(PEt_3)_2(NO_2)_2$ | [a]MC | 0.2 | 120 | MeCN-Acetone | — | — | — |
| Exam.1 | 1 | MC | 0.2 | 120 | MeCN-Acetone | — | 8 hr/100° C. | 5 × $E^3$ |
| Exam.2 | 1 | MC | 0.2 | 120 | MeCN-Acetone | 0.1 M/30 s | — | 3~4 |
| Exam.3 | 3 | MC | 0.2 | 90 | MeCN-Acetone | 0.1 M/30 s | — | 3~4 |
| Exam.4 | 4 | MC | 0.5 | 90 | MeCN-Acetone | 0.1 M/30 s | — | 4~5 |
| Exam.5 | 4 | MC | 0.5 | 90 | MeCN-Acetone | 0.1 M/30 s | 2 hr/100° C. | 0.8 |
| Exam.6 | 5 | [b]MeCN | 0.5 | 60 | MeCN Acetone | 0.1 M/30 s | 2 hr/100° C. | 0.5 |
| Exam.7 | 6 | MC | 0.5 | 60 | MeCN-Acetone | 0.1 M/30 s | 2 hr/100° C. | |
| Exam.8 | 7 | [c]IPA | 2 | 5 | MeCN | 0.1 M/30 s | 3 min/100° C. | 13~44 |
| Exam.9 | 7 | MeCN | 2 | 5 | MeCN | 0.1 M/30 s | 3 min/100° C. | 10 |
| Exam.10 | 8 | MeCN | 2 | 3 | MeCN | 0.1 M/30 s | 3 min/100° C. | 40 |
| Exam.11 | 8 | IPA | 2 | 3 | MeCN | 0.1 M/30 s | 3 min/100° C./$N_2$atm. | 3~4 |
| Exam.12 | 9 | MeCN | 2 | 5 | MeCN | 0.1 M/30 s | — | 30 |
| Exam.13 | 10 | MeCN | 2 | 10 | MeCN | 0.1 M/30 s | — | 100 |
| Exam.14 | 11 | MeCN | 2 | 30 | MeCN | 0.1 M/30 s | — | 130 |
| Exam.15 | 12 | MeCN | 2 | 30 | MeCN | 0.1 M/30 s | — | 200 |
| Exam.16 | 13 | MeCN | 2 | 5 | MeCN | 0.1 M/30 s | — | 50 |
| Exam.17 | 14 | MeCN | 2 | 10 | MeCN | 0.1 M/30 s | — | 100 |

[1]Organo.: organometallic precursor of the present invention
[2]Coa.: coating solvent
[3]Con.: concentration (M)
[4]Time: exposure time (mm)
[5]Dev.: developing solvent
[6]Reduct.: reduction (Hydrazine in IPA)
[7]Anneal: annealing
[8]Res.: Specific resistance ($\mu\Omega$-cm)
[a]MC: methylene chloride
[b]MeCN: acetonitrile
[c]IPA: isopropyl alcohol

EXAMPLES 18 AND 19

An organometallic precursor (8) synthesized in preparation example 8 was dissolved in acetonitrile to produce 0.1 M and 0.01 M solutions, and each solution was then applied on a glass substrate in an air atmosphere according to a spin coating process. The resulting coating film was exposed through a photomask by a broadband UV light generated by Oriel 60200 (200 W, Oriel, USA) for 90 sec, developed using acetonitrile, and reduced by 0.1 M hydrazine solution (in isopropyl alcohol) for 30 sec to form a metal pattern. Electrophotograms of the metal pattern thus formed were taken, and are shown in FIGS. 1 (0.1 M) and 2 (0.01 M).

EXAMPLES 20 TO 28

An organometallic precursor (8) synthesized in preparation example 8 was mixed with other organometallic precursors in proper ratios, as will be described in Table 2 below, and the resulting mixtures were dissolved in a coating solvent to produce precursor solutions containing 5M Ag, and each solution was then applied on a glass substrate in an air atmosphere according to a spin coating process. The resulting coating film was exposed through a photomask by a broadband UV light generated by Oriel 60200 (200 W, Oriel, USA), and developed using a developing solvent. The developed film was reduced by 0.1 M hydrazine solution (in isopropyl alcohol) and annealed in an air atmosphere at 100° C.

TABLE 2

| Exam. | [1]Organo. | [2]Other. | [3]Con | [4]Coa. | [5]Time | [6]Dev. | [7]Reduct. | [8]Anneal. | [9]Res. |
|---|---|---|---|---|---|---|---|---|---|
| 20 | 8 | $Ti(OiPr)_4$ | 1 | IPA | 5 | IPA | 0.1 M/30 s | 3 min/100 ° C. | 120 |
| 21 | 8 | $Ti(OiPr)_4$ | 3 | IPA | 10 | IPA | 0.1 M/30 s | 3 min/100 ° C. | 600 |
| 22 | 8 | $Ti(OiPr)_4$ | 10 | IPA | 10 | IPA | 0.1 M/30 s | 3 min/100 ° C. | 8000 |
| 23 | 8 | 14 | 5 | MeCN | 5 | MeCN | 0.1 M/30 s | 3 min/100 ° C. | 20 |
| 24 | 8 | 14 | 3 | MeCN | 5 | MeCN | 0.1 M/30 s | 3 min/100 ° C. | 12 |
| 25 | 8 | 14 | 1 | MeCN | 5 | MeCN | 0.1 M/30 s | 3 min/100 ° C. | 12 |

TABLE 2-continued

| Exam. | [1]Organo. | [2]Other. | [3]Con | [4]Coa. | [5]Time | [6]Dev. | [7]Reduct. | [8]Anneal. | [9]Res. |
|---|---|---|---|---|---|---|---|---|---|
| 26 | 8 | $Mo(CO)_6$ | 3 | THF | 10 | MeCN | 0.1 M/30 s | 3 min/100 ° C. | 100 |
| 27 | 8 | $Cr(CO)_6$ | 3 | THF | 5 | MeCN | 0.1 M/30 s | 3 min/100 ° C. | 80 |
| 28 | 8 | $Ru_3(CO)_{12}$ | 2 | MeCN | 10 | MeCN | 1 M/30 s | 3 min/100 ° C. | 30 |

[1]Organo.: organometallic precursor of the present invention
[2]Other.: other organometallic precursor known in the art
[3]Con.: concentration of other organometallic precursor in an organometallic precursor mixture (wt % based on Ag metal)
[4]Coa.: coating solvent
[5]Time: exposure time (min)
[6]Dev.: developing solvent
[7]Reduct.: reduction (Hydrazine in IPA)
[8]Anneal.: annealing
[9]Res.: specific resistance ($\mu\Omega$-cm)

As described above, the present invention is advantageous in that an electrically conductive metal pattern can be readily formed using an inventive organometallic precursor through an exposing step without using a separate photosensitive resin. Another advantage is that exposure time required to dissociate organic ligands from metals of the organometallic precursor is so short as to make the overall pattern process efficient.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. An organometallic precursor for forming a metal pattern defined by the following Formula (I):

$$M_mL_nL'_oX_p \quad (I)$$

wherein,

M is a transition metal selected from the group consisting of Ag, Au, and Cu;

L is a neutral ligand selected from the group consisting of amines, phosphines, phosphites, phosphine oxides, arsines, and thiols;

L' is a negatively charged ligand selected from the group consisting of β-diketonates, β-ketoiminates, β-diiminates, carboxylates, and dialkyldithiocarbamates;

X is an anion selected from the group consisting of halogeno, hydroxide ($OH^-$), cyanide ($CN^-$), nitrite ($NO_2^-$), nitrate ($NO_3^-$), nitroxyl ($NO^-$), azide ($N_3^-$), thiocyanato, isothiocyanato, tetralkylborate, tetrahaloborate, hexafluorophosphate ($PF_6^-$), triflate ($CF_3SO_3^-$), tosylate ($Ts^-$), sulfate ($SO_4^{2-}$), and carbonate ($CO_3^{2-}$);

m is an integer ranging from 1 to 10;

n is an integer ranging from 1 to 40;

o is an integer ranging from 0 to 10; and p is an integer ranging from 0 to 10.

2. The organometallic precursor according to claim 1, wherein M is Ag or Au; L is a neutral ligand selected from the group consisting of primary aliphatic amines, phosphites, and phosphine oxides; L' is a negatively charged ligand selected from the group consisting of β-diketonates, β-diiminates, and carboxylates; X is an anion selected from the group consisting of cyanide ($CN^-$), nitrite ($NO_2^-$), and nitrate ($NO_3^-$); m is an integer ranging from 1 to 10; n is an integer ranging from 1 to 40; o is an integer ranging from 0 to 10; and p is an integer ranging from 0 to 10.

3. A method of forming a metal pattern, comprising the steps of:

dissolving the organometallic precursor of claim 1 in an organic solvent to provide a coating solution;

applying the coating solution to a substrate to form a thin film on the substrate;

exposing the thin film with the use of a photomask; and developing the exposed thin film to form a metal or a metal oxide pattern on the substrate.

4. The method according to claim 3, wherein the substrate is made of an inorganic material, or a composite thereof.

5. The method according to claim 3, wherein the coating step is conducted according to a spin coating process, a roll coating process, a dip coating process, a spray coating process, a flow coating process, or a screen printing process.

6. The method according to claim 3, wherein the organic solvent is selected from the group consisting of nitril-based solvents, aliphatic hydrocarbon-based solvents, aromatic hydrocarbon-based solvents, ketone-based solvents, ether-based solvents, acetate-based solvents, alcohol-based solvents, silicone-based solvents, and mixtures thereof.

7. The method according to claim 3, wherein the exposing step is conducted using ultraviolet light as a source of light.

8. The method according to claim 3, further comprising the steps of oxidizing, reducing, and/or annealing the metal or metal oxide pattern after the developing step.

9. The method according to claim 8, wherein the annealing step is conducted under a mixed gas atmosphere of hydrogen with nitrogen, a nitrogen gas atmosphere, or an air atmosphere at 300° C. or lower.

10. An organometallic precursor mixture for forming a metal pattern, produced by mixing the organometallic precursor of claim 1 with another organometallic precursor defined by the following Formula (II) in a metal weight ratio of 99.1:0.1 to 80:20:

$$M'_aL''_bL'''_cX_p \quad (II)$$

wherein,

M' is a transition metal selected from the group consisting of Ti, Zr, V, Ta, Cr, Mo, W, Mn, Fe, Ru, Os, Co, Rh, Ir, Ni, Pd, Pt, Cu, Ag, and Au, or an alkaline earth metal selected from the group consisting of Mg, Ca, Sr, and Ba;

L" is a neutral ligand selected from the group consisting of amines, phosphines, phosphites, phosphine oxides, arsines, thiols, carbonyl compounds, alkenes, alkynes, and arenes;

L'" is a negatively charged ligand selected from the group consisting of alkyl, β-diketonates, β-ketoiminates, β-diiminates, carboxylates, dialkyldithiocarbamates, alkoxides, and amidos;

X is an anion selected from the group consisting of halogeno, hydroxide ($OH^-$), cyanide ($CN^-$), nitrite ($NO_2^-$), nitrate ($NO_3^-$), nitroxyl ($NO^-$), azide ($N_3^-$), thiocyanato, isothiocyanato, tetralkylborate, tetrahaloborate, hexafluorophosphate ($PF_6^-$), triflate ($CF_3SO_3^-$), tosylate ($Ts^-$), sulfate ($SO_4^{2-}$), and carbonate ($CO_3^{2-}$);

a is an integer ranging from 1 to 10;

b is an integer ranging from 1 to 40;

c is an integer ranging from 0 to 10; and p is an integer ranging from 0 to 10.

11. A method of forming a metal pattern, comprising the steps of:

dissolving the organometallic precursor mixture of claim 10 in an organic solvent to provide a coating solution;

applying the coating solution to a substrate to form a thin film on the substrate;

exposing the thin film with the use of a photomask; and developing the exposed thin film too form a metal alloy or a metal alloy oxide pattern on the substrate.

12. The method according to claim 11, wherein the substrate is made of an inorganic material, an organic material, or a composite thereof.

13. The method according to claim 11, wherein the coating step is conducted according to a spin coating process, a roll coating process, a dip coating process, a spray coating process, a flow coating process, or a screen printing process.

14. The method according to claim 11, wherein the organic solvent is selected from the group consisting of nitril-based solvents, aliphatic hydrocarbon-based solvents, aromatic hydrocarbon-based solvents, ketone-based solvents, ether-based solvents, acetate-based solvents, alcohol-based solvents, silicone-based solvents, and mixtures thereof.

15. The method according to claim 11, wherein the exposing step is conducted using ultraviolet light as a source of light.

16. The method according to claim 11, further comprising the steps of oxidizing, reducing, and/or annealing the metal alloy or metal alloy oxide pattern after the developing step.

17. The method according to claim 16, wherein the annealing step is conducted under a mixed gas atmosphere of hydrogen with nitrogen, a nitrogen gas atmosphere, or an air atmosphere at 300° C. or lower.

* * * * *